United States Patent [19]

Kerr

[11] 4,027,609

[45] June 7, 1977

[54] FEED MECHANISM FOR SEWING MACHINES

[75] Inventor: Alexander Fraser Kerr, Dumbarton, Scotland

[73] Assignee: The Singer Company, New York, N.Y.

[22] Filed: June 25, 1976

[21] Appl. No.: 699,764

[30] Foreign Application Priority Data

May 5, 1976 United Kingdom..... 18460/76

[52] U.S. Cl. ..... 112/209; 112/215

[51] Int. Cl.[2] ..... D05B 27/08

[58] Field of Search ..... 112/208, 209, 210, 215

[56] References Cited

UNITED STATES PATENTS

| | | | |
|---|---|---|---|
| 3,174,449 | 3/1965 | Bono | 112/209 |
| 3,368,507 | 2/1968 | Orth | 112/209 |
| 3,382,827 | 5/1968 | Hagen | 112/209 |
| 3,970,018 | 7/1976 | Hager | 112/209 X |

*Primary Examiner*—George H. Krizmanich
*Attorney, Agent, or Firm*—Edward L. Bell; Robert E. Smith; Julian Falk

[57] ABSTRACT

This disclosure relates to feed mechanisms for sewing machines, particularly industrial sewing machines. A reciprocatory advance motion is imparted to a feed dog means by an eccentric means connected to a driven shaft in the machine and to a feed advance shaft which imparts an oscillating motion to the feed dog means. A feed dog lift means for imparting a lift motion to the feed dog includes an eccentric means also connected to the driven shaft. The mechanisms for imparting advance motion and lift motion to the feed dog are connected to a common fulcrum pin to provide a sturdy and stable mechanism capable of operating at high speeds with minimum noise and vibration. A second feed dog means is provided which has a common advance mechanism and a similar lift mechanism as the first mentioned feed dog means with each of the feed dog means being individually adjustable to provide a differential feed system in which two work feeding elements are adapted to be actuated so as to exert unequal feeding actions on the work, if desired.

7 Claims, 3 Drawing Figures

FEED MECHANISM FOR SEWING MACHINES

BACKGROUND OF THE INVENTION

The present invention relates to feed mechanisms for sewing machines and more specifically to a differential feed mechanism for an industrial sewing machine. Industrial sewing machines, as for example, the type shown in U.S. Pat. No. 2,771,848 to Knaus et al are exposed to very heavy-duty cycles at high-speed operation, as for example, rates in excess of 5,000 stitches per minute. It is desirable under such circumstances to provide a feed mechanism which is stable at high-speed operation and is substantially free of noise and vibration. The feed mechanism of the present invention provides a stable mechanism at high speed operation which does not depend on the manufacture and use of slide bearings and associated fork mechanisms which are commonly used in feed mechanisms for industrial sewing machines. In accordance with the structure of the present invention a single feed advance eccentric mechanism is used to drive a feed advance shaft common to two feed dog mechanisms of a differential feed system. Each feed dog mechanism is independently provided with a lift motion by an associated feed lift eccentric and each is also independently adjustable relative to the other for varying the feed stroke of each said feed mechanism. The feed dog member of each of the feed dog mechanisms is provided with a support member which is connected to a fulcrum pin which pin serves as a common connection for the feed dog support member, feed lift eccentric associated therewith and a link drive from the feed advance shaft. Such a connection provides for stability and reduced vibration since side thrusts on the mechanism are minimized.

SUMMARY OF THE INVENTION

In the preferred embodiment of the present invention, the feed mechanism includes in general a driven shaft which carries a first eccentric means operatively connected to a feed advance shaft for imparting an oscillatory motion thereto. A link means is also connected to the feed advance shaft at one end thereof and to a feed dog support member at the other end thereof, thus imparting a reciprocating motion to the feed dog. In order to impart a feed lifting motion to the feed dog a second eccentric is connected to the driven shaft and a pitman is provided which is connected at a common support with the link means and the feed dog support member. A second link means is also connected to the feed advance shaft and to a support member of a second feed dog mechanism and a third eccentric member is carried by the driven shaft and is also provided with a pitman connected to a common support means with the second link means and a support member for the second mentioned feed dog member. Each of the aforementioned link means is independently adjustable relative to the other so that the advance stroke of each of the feed dogs can be adjusted relative to the other for providing a differential feed in which the two feed dogs are adapted to be actuated so as to exert unequal feeding actions on the work, thereby either to stretch or pull the work, as required.

Accordingly, it is one object of the invention to provide a novel and improved feed mechanism for a sewing machine.

It is another object of the invention to provide a novel and improved differential feed mechanism for a sewing machine.

It is a further object of the invention to provide a novel and improved differential mechanism for an industrial sewing machine wherein a common connection is provided for the feed advance, feed lift and feed support means for each of the feed dogs of the sewing machine.

Other objects and advantages of the invention will be best understood upon reading the following detailed description with the accompanying drawings as identified below.

DESCRIPTION OF THE INVENTION

Figure 2:
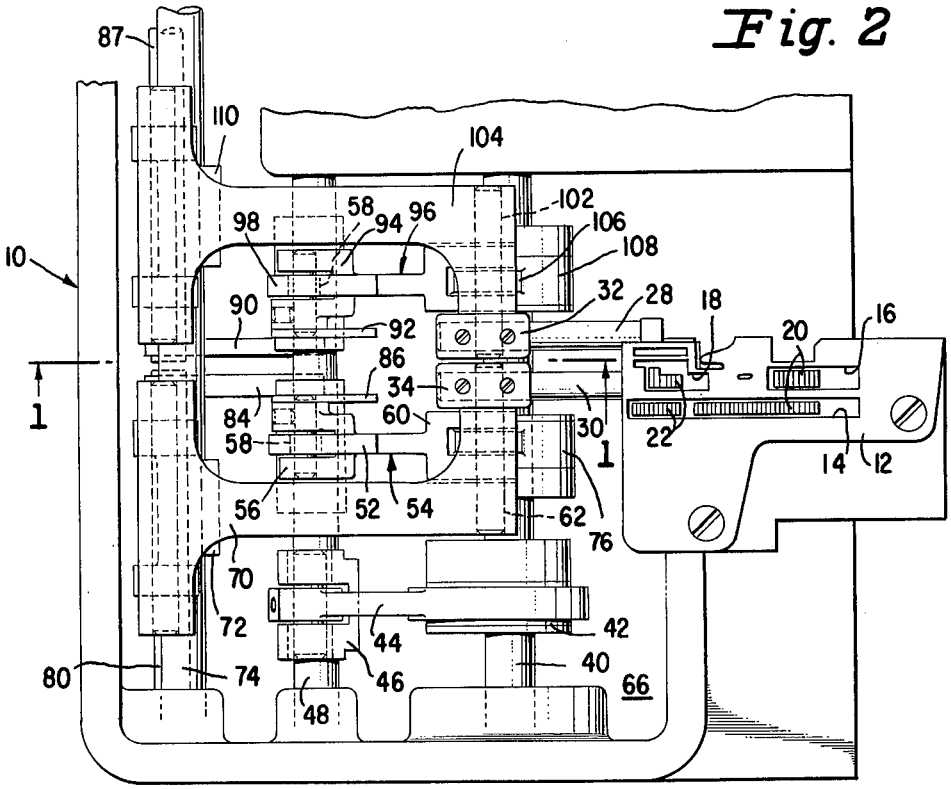
FIG. 2 is a top-plan view of a portion of the bed of a sewing machine with a part of the cover removed therefrom to illustrate the mechanism of the invention.
Figure 1:
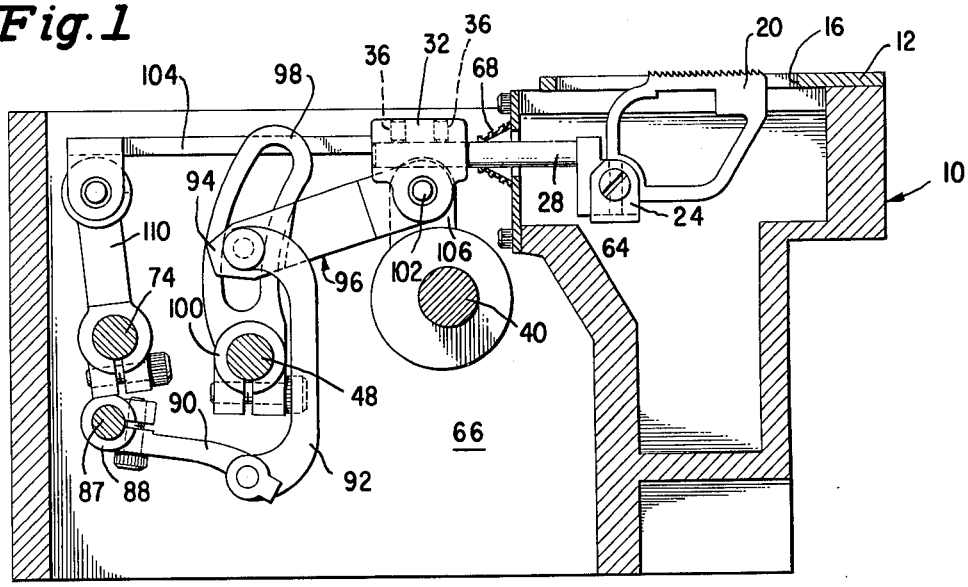
FIG. 1 is a cross-sectional view of a sewing machine taken along Line 1—1 of FIG. 2.
Figure 3:
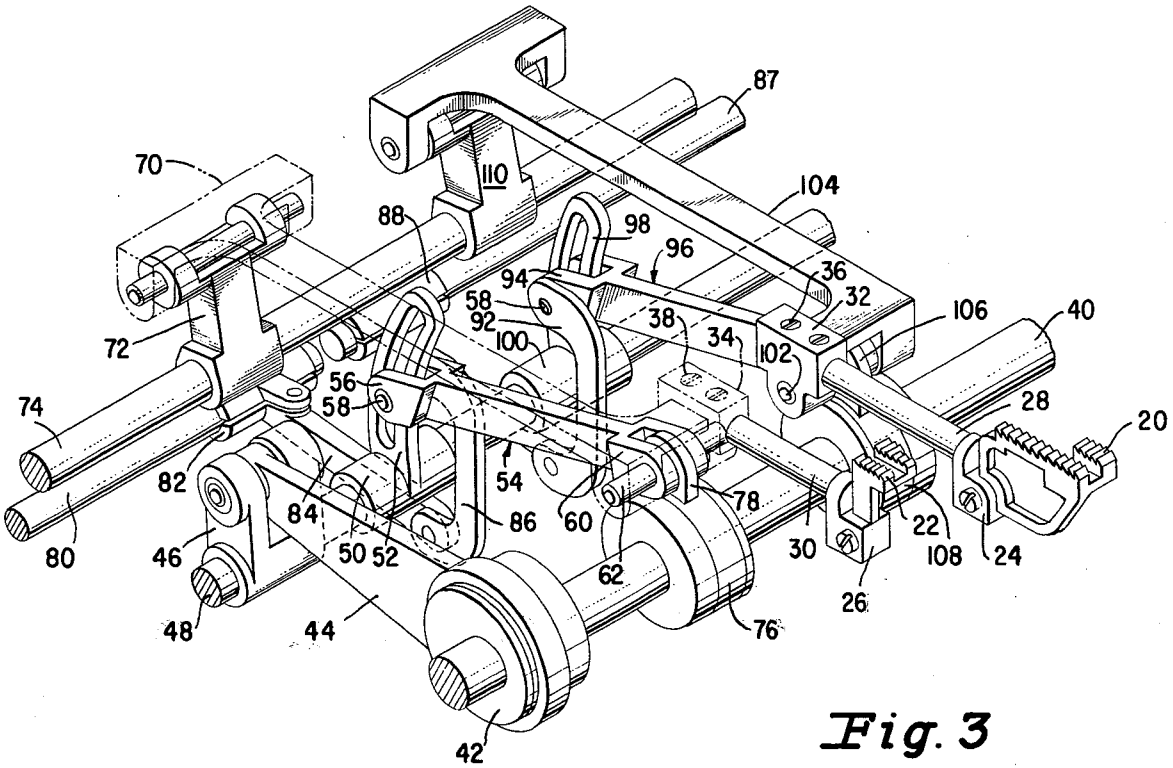
FIG. 3 is a perspective view of the elements of the feed mechanism of the invention with portions thereof having their dimensions exaggerated for purposes of clarity of illustration.

Referring to the drawings, in particular FIGS. 1 and 2, a portion of the bed of a sewing machine of the industrial type is illustrated as including a casing 10 upon which is mounted a throat plate 12 with openings 14, 16 and 18 therein for permitting feed dog members 20 and 22 to engage a fabric for feeding the same across the throat plate 12 and the work bed surface of the sewing machine, in a known manner. The feed dogs 20 and 22 are respectively supported in feed dog blocks 24 and 26 (FIG. 3) which in turn are carried by feed dog support shafts 28 and 30 which are secured in turn in feed dog support members 32 and 34. The feed dog support shafts 28 and 30 are so supported in the feed dog support members 32 and 34 so that their position with respect to the front and rear of the machine may be adjusted and also allows the teeth of the feed dogs to be leveled relative to the throat plate surface independently of each other. Such adjustment may take the form as illustrated which comprises a bore in each of the support block members 32 and 34 for receiving the shafts 28 and 30 and which are adjustably secured by means of screws 36 and 38.

In order to impart feeding motion to the feed dogs 20 and 22 a drive or bed shaft 40 is supported in the casing 10 and is connected to an electric motor or the like in a well-known manner. A eccentric 42 is connected to the drive shaft 40 in driving relationship therewith and a pitman 44 is connected to the eccentric at one end thereof and is pivotly connected to a crank 46 at the other end thereof which crank 46 is fixably connected to a feed advance shaft 48. It will be apparent that during rotation of the drive shaft 40 the eccentric mechanism through pitman 44 and crank 46 will impart an oscillatory movement to the feed advance shaft 48. A collar member 50 is fixably carried by the shaft 48 in a position adjacent to the crank 46 and has extending therefrom a slotted lever 52. A link member 54 is connected at one end to the slotted lever 52 by means of a forked end 56 which carries a slide block 58 (FIG. 1) therein for riding in the slot of the slotted lever 52. The opposite end of the link member 54 also has a forked shape illustrated at 60 and is supported on a fulcrum pin 62 in a manner which will be more fully described hereinafter.

With further reference to the drawings it will be seen that the feed dog support member 34 is also supported on the fulcrum pin 62 so that reciprocatory motion imparted to the link member 54 by virtue of its connection to the feed advance shaft 48 will be imparted to the feed dog 22. With particular reference to FIG. 1 it will be seen that the feed dog support shaft 30 extends through wall 64 of casing 10. In an industrial machine of the type disclosed herein it is intended that the cavity 66 in the casing 10 be oil-filled for purposes of lubrication. However, it is undesirable that oil leak from the cavity 66 through the wall 64 where it may come in contact with the fabric fed through the machine. In order to prevent such leakage from the cavity 66 a Bellows-type oil seal 68 is carried by wall 64 and shaft 30 in a manner to permit motion of the shaft 30 in more than one direction as it passes though the wall 64 but yet preventing any oil from leaking through the wall 64 from cavity 66. A similar type oil seal (not shown) is also provided for shaft 28.

It is desirable that the feed dog 22 during its to and fro motion for feeding the fabric, follow paths in each direction which remain substantially parallel. In order to help maintain this path of travel, a feed bar 70 is connected to the feed dog support member 34 and to the fulcrum pin 62 as illustrated, and at its opposite end is pivotly connected to a Y-shaped lock lever 72 which is fixed to a rock shaft 74. By virtue of the distance between the connecting points of the feed bar 70 and the motion restraint provided by the rock shaft 74 and feed bar 70 the to and fro motion of the feed dog member 22 is substantially restrained to a linear reciprocatory motion. Such a mechanism for restraining the motion as described thus far is in and of itself well known in the art.

A differential feed mechanism of the invention is also of the four motion feed type in which not only to and fro motion is provided for the feed dog but a lifting motion in a direction substantially perpendicular to the to and fro motion is also provided so that the fabric will be engaged by the feed dogs during feeding thereof, and released after each feeding increment. In order to provide such lifting motion a feed lift eccentric 76 is fixed to the driven shaft 40 and carries thereon a pitman 78 which is attached to the fulcrum pin 62. Therefore, during rotation of the driven shaft 40, the eccentric 76 will impart a substantially vertical component to the pitman 78 which through the fulcrum pin 62 will be imparted to the feed dog support member 34 resulting in a lifting motion of the feed dog 22.

It will also be apparent that, if the initial adjusted position of the link 54 is changed with respect to the slotted lever 52, the length of stroke of the feed advance to the feed dog 22 will be varied. In other words, the length of the feed advance stroke of the feed dog 22 can be lengthened or shortened by adjusting the relative position of the slide block 58 in the slot of the slotted lever 52. In order to bring about such adjustments a feed adjustment shaft 80 is provided for the feed dog 22 and has fixed thereon a collar 82 which carries a link 84 connected to a substantially C-shaped lever 86 which is pivotally connected to the link 84 at one end thereof and is connected to the forked end 56 of the link member 54 at the other end thereof. The feed adjusting shaft may carry a manual adjusting means such as a knob or lever at one end thereof on the exterior of the machine so that the operator can change or regulate the feed adjusting stroke. It will be apparent that upon rotation of the shaft 80 the relative position of the slide block in the slot in the slotted lever 52 will be changed thereby regulating the feed stroke in accordance with said adjustment of the feed adjustment shaft 80. A similar but independently adjustable feed adjusting shaft 87 is provided for the feed dog 20 and has associated mechanism including collar 88 link 90, C-shaped lever 92, which is connected to the forked end 94 of link 96, which forked end 94 carries a slide block similar to the slide block 58, and which is carried in a slot in the slotted lever 98 in turn carried by collar 100 on shaft 48. The link 96 is connected to a fulcrum pin 102 which also carries one end of a feed bar 104 and the pitman 106 of a third lift eccentric 108. The feed bar 104 is supported at its other end in a pivotable manner to a Y-shaped rock lever 110 which is fixed to shaft 74, as illustrated. It will be apparent that the feed advance and lift mechanism of the feed dog 20 is substantially identical to the feed advance and lift mechanism of the feed dog 22, the only exception being that the adjusting mechanism for each feed dog mechanism is independent of the other so that the feed dog motions may be individually adjusted for providing differences in their relative motions.

As described above, and seen on the drawings, a single or common advance eccentric is provided for both feed dogs of the differential feed system with each feed dog thereof being independently adjustable relative to the other. The feed advance mechanism including the feed advance shaft and associated linkage for each feed dog, the feed bar and the lift mechanism are all mounted at a common connection, namely fulcrum pins 62 and 102, respectively, for each feed dog 20 and 22. By virtue of this common mounting for the aforementioned mechanisms a sturdy and stable drive mechanism is provided for the feed which has reduced noise and vibration characteristics. Also by virtue of this construction there is an absence of the requirement for slide bearings and associated feed fork mechanisms which are commonly required in other feed mechanisms of known types. This results in a reduction of components that are normally subject to wear. The construction of the invention provides for a novel combination of features which results in an industrial sewing machine which is capable of operating at relatively high speeds with relatively great accuracy and substantially reduces vibration, noise and wear of the feeding elements thereof.

While the invention has been described in its preferred embodiment, it will be obvious to those skilled in the art, that various modifications and changes may be made therein without departing from the spirit and scope thereof.

Having thus set forth the nature of the invention, what is claimed herein is:

1. A feed mechanism for a sewing machine having a casing and a feed mechanism supported therein, said feed mechanism including feed dog means for advancing fabric through said sewing machine for sewing stitches therein, feed dog advance means for imparting a reciprocatory advance motion to said feed dog means including, a driven shaft, first eccentric means connected to said driven shaft and a feed advance shaft for imparting oscillating motion to said feed dog means, said feed dog means including a feed dog member and a feed dog support means for supporting said feed dog member, link means operably connecting said feed dog support means to said feed advance shaft, feed dog lift means for initiating lift motion to said feed dog member in a direction substantially perpendicular to the reciprocatory advance motion of said feed dog means, said feed dog lift means including second eccentric means connected to said driven shaft and being operably connected to said feed dog support means, and said second eccentric means and said link means having a common connection with said feed dog support means.

2. A feed mechanism as recited in claim 1 further comprising feed regulating means for varying the motion of said feed dog means, said feed regulating means comprising a slotted lever means connected to said feed advance shaft for oscillating movement therewith, said link means including a slide member disposed in an elongated slot in said slotted lever means for movement within said slot during motion of said slotted lever means, and regulating mechanism for changing the relative position of said slotted lever and said slide member such that the motion of said link means may be varied in accordance with changes in the relative positions of said slotted lever and said slide member.

3. A feed mechanism as recited in claim 1 further comprising a second feed dog means including a second feed dog member and a second feed dog support means for supporting said second feed dog member, second link means connecting said feed dog support means to said feed advance shaft whereby a reciprocatory advance motion is imparted thereto, feed dog lift means for said second feed dog means including a third eccentric means connected to said driven shaft and operatively connected to said second feed dog support means for initiating lift motion to said feed dog member, and said third eccentric means and said second link means having a common connection with said second feed dog support means.

4. A feed mechanism as recited in claim 3 further comprising feed stroke adjustment means including means for independently adjusting the strokes of said feed dog means and said second feed dog means.

5. A feed mechanism as recited in claim 4 wherein said feed stroke adjustment means includes means for selectively changing the relative adjusted positions of said link means and said second link means with respect to said feed advance shaft.

6. A feed mechanism as recited in claim 3 further comprising a rock shaft, a first feed bar connected to said rock shaft and the common connection with said second eccentric means, said link means and said feed dog support means, and a second feed bar connected to said rock shaft and said third eccentric means, said second link means and said second feed dog support means for maintaining a substantially parallel path of motion for the reciprocatory advance motion of said feed dog means and said second feed dog means.

7. A feed mechanism as recited in claim 1 further comprising a second feed dog means with said second feed dog means being driven by said first eccentric means and said feed advance shaft such that a reciprocatory feed advance motion is imparted to said second feed dog means, and second feed dog lift means including a third eccentric means connected to said driven shaft for initiating a lift motion to said second feed dog means.

* * * * *